US007461990B2

(12) United States Patent
Biegel

(10) Patent No.: US 7,461,990 B2
(45) Date of Patent: Dec. 9, 2008

(54) APPLICATOR DEVICE

(75) Inventor: Friedrich Biegel, Nuremberg (DE)

(73) Assignee: Schwan-STABILO Cosmetics GmbH & Co. KG (DE)

( * ) Notice: Subject to any disclaimer, the term of this patent is extended or adjusted under 35 U.S.C. 154(b) by 411 days.

(21) Appl. No.: 11/179,407

(22) Filed: Jul. 12, 2005

(65) Prior Publication Data

US 2006/0222447 A1 Oct. 5, 2006

(30) Foreign Application Priority Data

Mar. 30, 2005 (DE) ..... 10 2005 014 407

(51) Int. Cl.
*B43K 23/08* (2006.01)
*B43K 7/10* (2006.01)

(52) U.S. Cl. ..... 401/213; 401/216

(58) Field of Classification Search ..... 401/208–216; 277/628

See application file for complete search history.

(56) References Cited

U.S. PATENT DOCUMENTS

| | | | | |
|---|---|---|---|---|
| 2,942,762 | A | 6/1960 | Fahr | |
| 5,484,566 | A | 1/1996 | Gabbard | |
| 5,762,435 | A * | 6/1998 | Fukushima | 401/213 |
| 6,415,959 | B1 | 7/2002 | Bougamont et al. | |
| 6,428,235 | B1 * | 8/2002 | Takanashi et al. | 401/202 |
| 6,464,420 | B2 * | 10/2002 | Brunetti | 401/202 |
| 2004/0005185 | A1 | 1/2004 | Endo | |
| 2004/0239047 | A1 * | 12/2004 | Kent et al. | 277/628 |

FOREIGN PATENT DOCUMENTS

| | | |
|---|---|---|
| DE | 40 15 152 | 11/1990 |
| DE | 39 37 299 | 5/1991 |
| DE | 102 26 887 | 12/2003 |
| EP | 0 196 591 | 10/1986 |
| EP | 0 685 348 | 12/1995 |
| EP | 1 445 121 | 8/2004 |
| FR | 2 738 729 | 3/1997 |
| GB | 702922 | 1/1954 |
| JP | 10-180157 | 7/1998 |

* cited by examiner

*Primary Examiner*—David J Walczak
(74) *Attorney, Agent, or Firm*—Bachman & LaPointe, P.C.

(57) ABSTRACT

An applicator device comprising a storage space for a product to be applied comprising a front portion having a holder for rotatably holding a ball communicating with the storage space through an opening provided between the ball and the holder, wherein at least the front portion comprises plastic material.

6 Claims, 1 Drawing Sheet

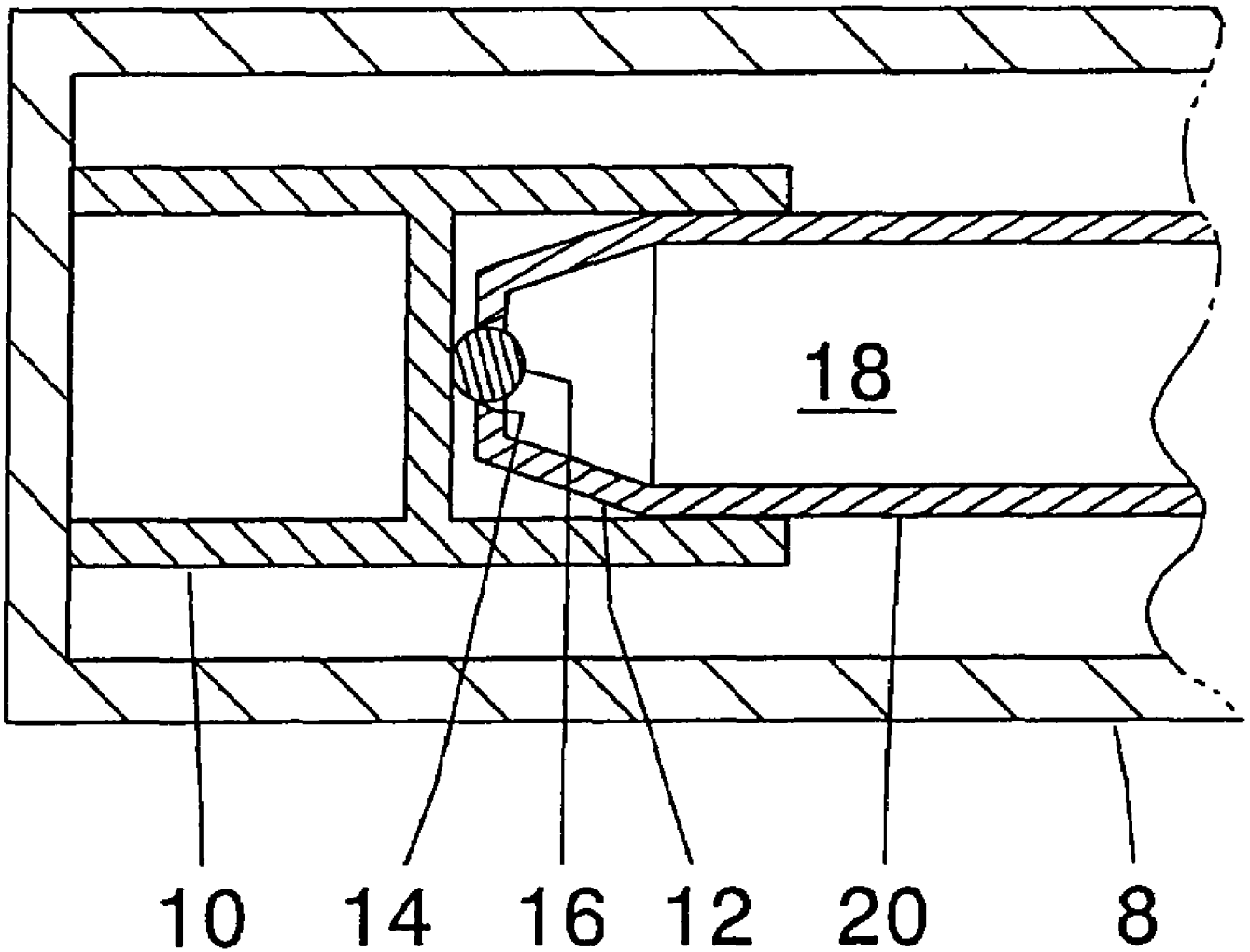
18
8
20
12
16
14
10

APPLICATOR DEVICE

BACKGROUND OF THE INVENTION

The invention concerns an applicator device comprising a storage means for the product to be applied, whose front portion has a holder for rotatably holding a ball communicating with the storage means, wherein a through opening is provided between the ball and the holder.

In other words the invention concerns an applicator device in the nature of a ballpoint pen. In that respect the applicator device can serve for the application of any applyable products. Primarily however it is envisaged as a cosmetic pencil.

Applicator devices of the kind set forth in the opening part of this specification generally use front portions which are in the form of tips and which are made of metal. In the production of those applicator tips it repeatedly happens that burrs occur, due to the production procedure involved. In use of the applicator device those burrs result in unpleasant scratching on the surface to which the product is applied and in the case of a cosmetic pencil result in an unpleasant feel in application. Injury can even occur. If the applicator device is to be used in the cosmetics sector, such burrs are therefore to be reliably avoided.

If the applicator device is used to apply product on the face or indeed in the proximity of the eyes, there is a psychological effect involved. If more specifically a metal point is guided in the direction of the face/eyes, it is immediately classified as being dangerous by virtue of the metallic shine, and that makes it difficult to use the applicator device for psychological reasons.

Therefore the object of the present invention is to improve the applicator device of the kind set forth in the opening part of this specification insofar as scratching on the application surface—and in the case of cosmetics the risk of injury that this entails—is minimised or indeed eliminated.

SUMMARY OF THE INVENTION

In accordance with the invention the specified object is attained in that at least the front portion has plastic material.

The use of plastic material when affording the front portion of the applicator device markedly reduces the risk of injury because any burrs and irregularities which are possibly present are of a substantially lesser degree of hardness.

In addition the psychological inhibition threshold level which is always latently present when using the applicator device for cosmetic purposes, particularly in the proximity of the eyes, is markedly reduced because an article which does not have a metallic shine is perceived as being less dangerous. A further advantage of using plastic material in the front portion is that it is possible to use injection molding processes which on the one hand are inexpensive and on the other hand simple.

Particularly when using the applicator device for cosmetic purposes, it is in that respect also advantageous that articles which are produced by injection molding are sterile after production because of the high temperatures involved in the processing procedure. More specifically, in contrast thereto, for example metal points are usually contaminated with processing solutions and therefore have to be cleaned and sterilised, with the complication and expenditure that this entails.

Preferably in accordance with the invention the front portion is at least partially translucent. That design configuration which for example entails the use of polypropylene or polyethylene as the material for the front portion has in particular the advantage over the configuration with a metal point that the color of the product to be applied can be recognised through the front portion.

In that way for example there is no need for additional color indicators on the applicator device.

In addition the possibility of viewing the product to be applied through the front portion affords, in terms of use, a psychological certainty which once again markedly reduces the inhibition threshold level when applying cosmetics on the face, in particular in the proximity of the eyes.

Additionally or alternatively the front portion can be of the same color as the product.

Under some circumstances constituents of the product to be applied can diffuse through the plastic material forming the front portion. Under some circumstances, that diffusion, particularly in respect of water, alcohols, hydrocarbons, silicones and the like, involves unwanted changes in concentration in the product to be applied, to the stage of starting to dry out. The loss of fluids in the region of the front portion is to be reduced to a minimum and as far as possible entirely avoided because in that case capillarities occur in the region of the ball within the product to be applied, which reduce the quality of application and can even lead to failure of the applicator device.

In accordance with the invention therefore there is preferably provided a cap having a seal for the front portion. That cap is fitted on to the applicator device in order to avoid the above-mentioned detrimental effects as long as the device is not in use.

It was ascertained by series of tests that, when using conventional sealing materials such as silicone, NBR or EPDM, the applicator devices, after a storage time of several weeks, were no longer in a position to immediately transfer the product to be applied, to the application surface, when they were brought into operation. Accordingly, to reactivate the applicator device, that is to say to restore applicability, it was necessary to initially write with the applicator device on a suitable auxiliary surface.

If an applicator device of that kind is used for applying cosmetic products to the skin, then previously initially writing on a surface with the applicator device is however already disadvantageous for the reason that in particular the ball can be unnecessarily contaminated with additional germs when initially writing on the auxiliary surface. That then results in germs being transferred into the product to be applied, which is not tolerable for hygiene reasons. Initially using the applicator device on the skin itself to start it working is also disadvantageous because the area in which the applicator device is used initially on the skin in that way has to be subsequently cleaned again.

Initially writing on a surface in that fashion is also disadvantageous when using the applicator device for non-cosmetic purposes because in that case the product to be applied is wasted.

In order to achieve appropriate sealing integrity, it is particularly provided in accordance with the invention that the seal has a hydrophobic material. In that way the fluids in the product to be applied, which have possibly diffused through the plastic material of the front portion, are not capable of penetrating into the seal material.

It is particularly preferred in that respect that the seal has a fluorine-bearing polymer.

Perfluoro rubber, fluoro rubber and fluorosilicone rubber have proven to be particularly suitable as the material for the seal.

According to the invention good sealing properties can additionally or alternatively also be achieved by the seal having butyl rubber.

According to the invention the seal can also comprise a mixture of butyl rubber and ethylene-propylene-diene terpolymers.

An embodiment of the invention provides that the seal comprises acrylonitrile-butadiene rubber, and more specifically is vapor-deposited with a barrier layer, the barrier layer preferably containing metal, in particular aluminum, gold, silver, platinum, copper, brass and/or bronze.

Finally the invention provides an applicator device in which the seal comprises acrylonitrile-butadiene rubber, more specifically modified with a material which at least partially fills the intermediate spaces between the polymer molecules, in particular wax.

BRIEF DESCRIPTION OF THE DRAWING

The invention is described in further detail hereinafter by means of preferred embodiments by way of example with reference to the accompanying drawing in which:

the single FIGURE shows a partial sectional view of the front portion of a cosmetic pencil with a seal.

DETAILED DESCRIPTION

The drawing shows a seal 10 which is provided in a cover 8 and which is fitted on to the front portion 12 of an applicator device with a ball 16 held in a holder 14. The internal space of the front portion represents a storage means 18 for a product to be applied, for example products to be applied in line form such as lipliner, eyeliner, mascara or kohl. Adjoining the front portion 12 is a casing 20 which is of metal or non-translucent plastic material such as for example ABS. The front portion 12 is of colorless translucent polypropylene so that for example the lipliner in the storage means 18 is visible from the exterior.

A number of examples of the pencil illustrated in the drawing were manufactured, which differed only in the sealing materials used in the respective cover. More specifically:

The seals are made from the different materials (see Table: Seal materials) and fitted into the cover of the applicator device. The application material is introduced into the storage means and the applicator device closed with a cover. The applicator devices are stored at 45° C. and after the specified times cooled to room temperature and after 24 hours subjected to an initial writing test. In that case the cover is removed from the applicator device and the pencil is used to start writing on a paper substrate.

The application image produced is assessed as follows:

| | |
|---|---|
| + | immediate continuous application |
| ○ | application line partly broken at the beginning |
| – | no application at the beginning |

Seal materials:

| | Name | Abbreviation | Substance class |
|---|---|---|---|
| Example 1 | Kalrez | FFPM | Perfluoro rubber |
| Example 2 | Viton | FPM | Fluoro rubber |
| Example 3 | Elastosil | VMQ | Fluorosilicone rubber |
| Example 4 | Polysar-butyl | IIR | Butyl rubber |
| Example 5 | Test seal 1 | | IIR/EPDEM mixture |
| Example 6 | Test seal 2 | | NBR; wax-modified |
| Example 7 | Test seal 3 | | NBR; vapor-deposited with aluminum |
| Comparative example 1 | Buna AP | EPDM | Ethylene-propylene-diene terpolymer |
| Comparative example 2 | Perbunen N | NBR | Acrylonitrile-butadiene rubber |
| Comparative example 3 | Silopren | VMQ | Silicone rubber |

Assessment of the application image after storage times of differing lengths:

| | Storage time | | | | |
|---|---|---|---|---|---|
| | None | 1 week | 2 weeks | 4 weeks | 8 weeks |
| Example 1 | + | + | + | + | + |
| Example 2 | + | + | + | + | + |
| Example 3 | + | + | + | + | + |
| Example 4 | + | + | + | + | + |
| Example 5 | + | + | + | + | ○ |
| Example 6 | + | + | + | + | ○ |
| Example 7 | + | + | + | + | + |
| Comparative example 1 | + | + | – | – | – |
| Comparative example 2 | + | ○ | – | – | – |
| Comparative example 3 | + | + | – | – | – |

As the foregoing Table shows the examples according to the invention, that is to say Examples 1 through 7, are all superior to the comparative examples. That applies in particular to Examples 1 through 4 and 7 which even after 8 weeks storage time gave very good results.

The features of the invention disclosed in the foregoing description, in the claims and the drawing can be essential both individually and also in any combination for implementing the invention in its various embodiments.

The invention claimed is:

1. An applicator device comprising, a casing defining a storage means for a product to be applied, the casing comprising a front portion having a holder for rotatably holding a ball communicating with the storage means through an opening provided between the ball and the holder, wherein the front portion comprises plastic material, and a cap having sealing means for contacting both the ball and the casing in a closed condition, wherein the seal comprises acrylonitrile-butadiene rubber modified with a material which at least partially fills the intermediate spaces between polymer molecules of the acrylonitrile-butadiene rubber.

2. An applicator device comprising a storage means for a product to be applied comprising a front portion having a holder for rotatably holding a ball communicating with the storage means through an opening provided between the ball and the holder, wherein the front portion comprises plastic material, a cap with a seal for the front portion, wherein the seal comprises acrylonitrile-butadiene rubber modified with a material which at least partially fills the intermediate spaces between polymer molecules of the acrylonitrile-butadiene rubber.

3. An applicator device as set forth in claim 1 or 2, wherein the front portion is of the same color as the product.

4. An applicator device as set forth in claim 1, wherein the modifying material is wax.

5. An applicator device as set forth in claim 1 or 2, wherein the front portion is at least partially translucent.

6. An applicator device as set forth in claim 2, wherein the modifying material is wax.

* * * * *